US006918387B2

(12) United States Patent
Klarich et al.

(10) Patent No.: US 6,918,387 B2
(45) Date of Patent: Jul. 19, 2005

(54) PORTABLE CAMPFIRE BARRIER SYSTEM

(76) Inventors: Edward A. Klarich, 10160 Roseboro Rd., Sandy, UT (US) 84092; Kevin E. Klarich, 13841 S. Vestry Rd., Draper, UT (US) 84020

( * ) Notice: Subject to any disclaimer, the term of this patent is extended or adjusted under 35 U.S.C. 154(b) by 0 days.

(21) Appl. No.: 10/461,633

(22) Filed: Jun. 12, 2003

(65) Prior Publication Data

US 2003/0230298 A1 Dec. 18, 2003

Related U.S. Application Data

(60) Provisional application No. 60/388,083, filed on Jun. 12, 2002.

(51) Int. Cl.[7] ..... F24C 15/36

(52) U.S. Cl. ..... 126/201; 126/9 B; 126/29

(58) Field of Search ..... 126/9 R, 29, 30, 126/9 B, 38, 25 R, 201, 519, 544, 42

(56) References Cited

U.S. PATENT DOCUMENTS

| | | | | | |
|---|---|---|---|---|---|
| 1,194,131 | A | * | 8/1916 | Brown | 126/29 |
| 1,221,514 | A | * | 4/1917 | Crain | 126/29 |
| 2,839,043 | A | * | 6/1958 | La Born | 126/30 |
| 3,858,495 | A | * | 1/1975 | Gotwalt | 99/421 HH |
| 4,126,116 | A | | 11/1978 | McCallum | 126/9 R |
| 4,363,313 | A | | 12/1982 | Smith | 126/9 R |
| 4,794,906 | A | | 1/1989 | Longley, Jr. | 126/9 R |
| 4,829,977 | A | * | 5/1989 | Valentine | 126/9 R |
| 4,977,824 | A | * | 12/1990 | Shinler | 126/9 B |
| 5,329,917 | A | | 7/1994 | Young | 126/29 |
| 5,682,872 | A | | 11/1997 | Whitted | 126/29 |
| D390,935 | S | | 2/1998 | Bosje et al. | |
| D423,867 | S | | 5/2000 | Cael et al. | |
| 6,425,387 | B1 | | 7/2002 | Rohback, Jr. | 126/9 R |
| 2002/0088457 | A1 | | 7/2002 | McDonald | 126/512 |
| 2003/0034023 | A1 | | 2/2003 | Meurer | 126/29 |

FOREIGN PATENT DOCUMENTS

| | | | |
|---|---|---|---|
| GB | 308104 A | * | 3/1929 |
| JP | 11-337071 | * | 10/1999 |

* cited by examiner

*Primary Examiner*—Josiah C. Cocks
(74) *Attorney, Agent, or Firm*—Clayton, Howarth & Cannon, P.C.

(57) ABSTRACT

A portable campfire barrier system for preventing the spread of a campfire beyond an established perimeter that includes a one-piece containment wall secured in a ready-to-use configuration by a plurality of support members. When not deployed in the ready-to-use configuration, the containment wall can be collapsed for facilitating both storage and transport due to its ductile nature. The containment wall is of sufficient height to avert the campfire from igniting fuel beyond the containment area but still allow for the pleasant enjoyment of the campfire. In one form, the support members are adapted to engage the containment wall with clip members in order to maintain the wall in the ready-to-use configuration. A band fastened to one end of the containment wall further assists in maintaining the wall in the ready-to-use configuration. The support members are further adapted to be driven into the ground thereby providing additional stability. Optionally, a grill can be positioned on or over the containment wall to receive heat from the campfire.

11 Claims, 8 Drawing Sheets

PORTABLE CAMPFIRE BARRIER SYSTEM

CROSS-REFERENCE TO RELATED APPLICATIONS

This application claims the benefit of U.S. Provisional Application No. 60/388,083 filed on Jun. 12, 2002, which is incorporated herein in its entirety to the extent that said U.S. Provisional Application is not inconsistent with the disclosure provided herein.

STATEMENT REGARDING FEDERALLY SPONSORED RESEARCH OR DEVELOPMENT

Not Applicable.

BACKGROUND

1. The Field of the Invention

The present invention relates generally to campfire containment, and more particularly, but not necessarily entirely, to a portable campfire containment system.

2. Description of Background Art

Sitting around a campfire is a favorite pastime for many people. Too often though, unattended or carelessly constructed campfires become the source of a wildfire which has the potential to cause damage to both property and natural resources. Further, wildfires can lead to the loss of human life, including the fire fighters combating the blaze. Because of the devastating destruction that can result from a campfire, civil authorities often ban campfires in times of extreme fire danger in certain areas.

The traditional method to build a campfire includes arranging several rocks in a ring, referred to as a "fire ring," to form a barrier between the fire and any combustible material, such as grass or wood surrounding the fire ring. Unfortunately, a fire ring of rocks often does little to stop a fire from spreading due to, among other things, the gaps between the rocks and the overall low height of the rock ring.

In established campgrounds, such as those operated by the U.S. forest service, permanent fire pits are constructed. A fire pit generally extends two to three feet deep into the ground. The wall of the pit can comprise cement, metal or some other fire resistant material. The wall of the pit serves to form an effective barrier in preventing the fire from spreading beyond the confines of the pit. The wall also serves as a support to prevent the surrounding dirt from collapsing into the pit. While there is no doubt that fire pits are more effective than a fire ring of rocks, the permanent nature of a fire pit, the work involved to prepare a fire pit and relative high cost makes them unavailable at most camp sites, especially where the camp site is not in an established campground.

Several portable campfire rings have been developed in an attempt to overcome the drawbacks of the ring of rocks and campfire pits as stated above. One such campfire ring is a portable device having a plurality of rigid panels for encircling a campfire. The rigid panels are interlocked end to end with hinges. The rigid panels can be deployed in a rectangular or hexagonal configuration. Each panel further has a plurality of draft slots.

Another available device is a camping furnace whose enclosure wall is substantially cylindrical in shape. The enclosure wall is further characterized by having vent openings located near its bottom edge. The enclosure wall can be made of separable and/or hinged sections so that it can be disassembled or collapsed for storage and transport.

Still another device provides a portable campfire ring comprised of a plurality of curved sections which are secured in an end-to-end relationship to form a semi-circle. The campfire ring is further comprised of a grill extension that is connected to the ends of the semi-circle. For storage and transport, the curved sections and grill extension are disassembled into separate pieces.

Yet another available device is a portable field stove which has a collapsed configuration for storage and transport and a set-up configuration for supporting a utensil above a heat source. The stove comprises a front plate and a back plate collapsibly connected together by foldable ends. The pieces are joined end-to-end by hinges, thereby allowing the stove to be collapsed.

Still another device for confining a campfire provides a portable campfire fireplace having a plurality of side walls and an adjustable cooking grill. The side walls are constructed of metal and are connected end-to-end by hinges. The hinges allow the side walls to be collapsed against each other for storage and transport.

An additional available device for confining a campfire provides a portable barbeque device having four panels. The panels are connected together in an end-to-end configuration by hinges. The hinges allow the panels to be folded together in a collapsed configuration for storage and transport.

All of the aforementioned devices provide various types of portable devices for containing a fire within a confined area. In general, the described devices are characterized by being comprised of sectional pieces joined together to form a campfire ring or wall. The sectional pieces are typically rigid in nature and are either releasably connected together to form a wall or are connected with a hinge. The devices can be disassembled or collapsed for storage when not in use. Disassembly or collapsing of the device also aids in transporting the devices.

One disadvantage of the previously available devices is that disassembly results in multiple pieces having to be transported and stored. It is also a significant disadvantage of rigid panels in that tedious assembly and disassembly is required. Another disadvantage is that the size of the containment area cannot be finely adjusted in size due to the rigid nature of the sectional pieces. Further, the multiple pieces of the described devices increases manufacturing costs.

The previously available devices are thus characterized by several disadvantages that are addressed by the present invention. The present invention minimizes, and in some aspects eliminates, the above-mentioned failures, and other problems, by utilizing the methods and structural features described herein.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE ILLUSTRATIVE EMBODIMENTS

Figure 1:
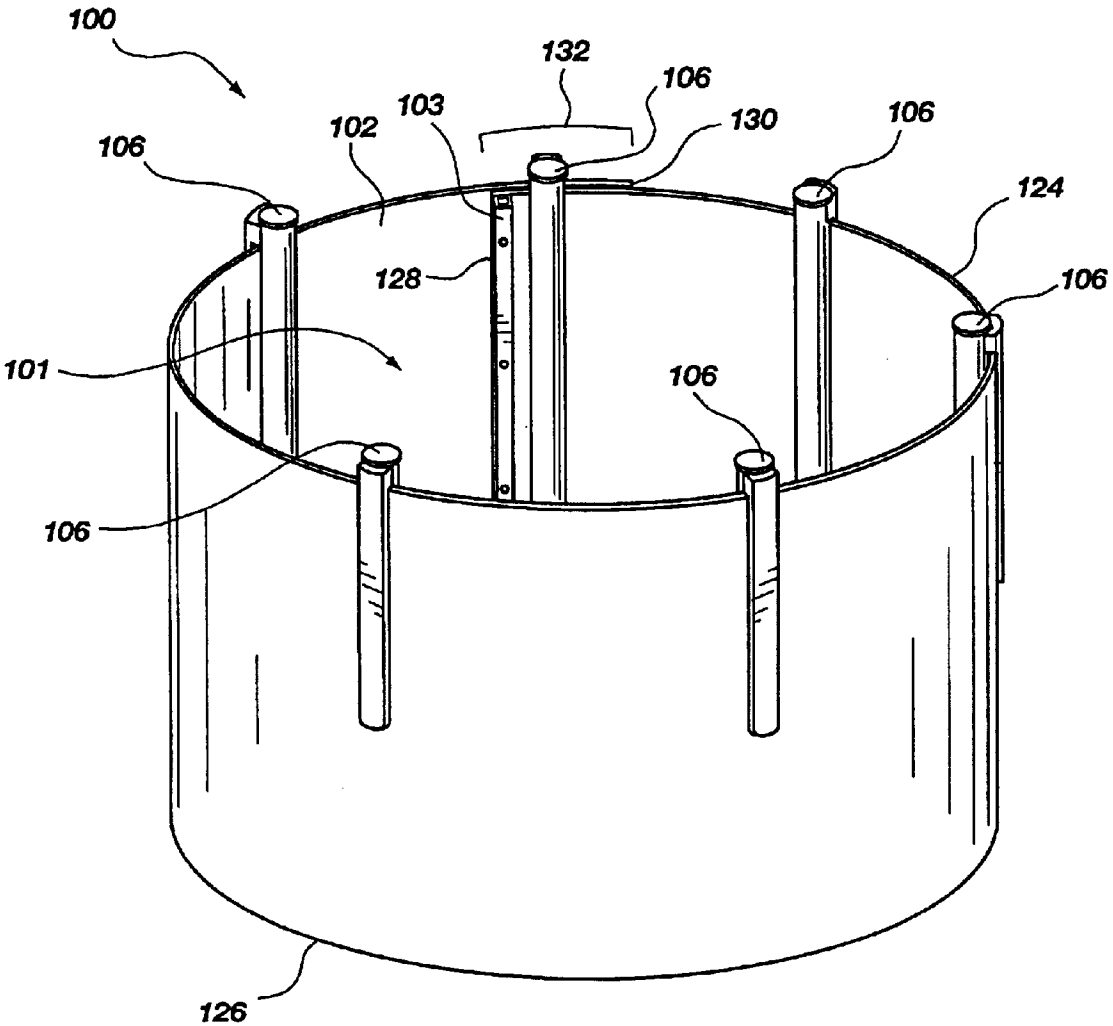
FIG. 1 is a perspective view of one illustrative embodiment of the present invention in a ready-to-use configuration.

The features and advantages of the present invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise. As used herein, "comprising," "including," "containing," "characterized by," and grammatical equivalents thereof are inclusive or open-ended terms that do not exclude additional, unrecited elements or method steps.

Advantageously, the illustrated embodiments of the present invention provide a barrier which can be used to form a containment wall. It will be appreciated that the area enclosed by the containment wall can be readily adjusted in size depending on the needs of the user. In addition, the present invention can be easily deployed and taken down in a relatively short period of time. Advantageously, the one piece construction of the illustrative embodiments also lowers manufacturing and labor costs. Further, the lack of moving parts also diminishes need for repair of the embodiments of the present invention. Furthermore, the illustrative embodiments of the present invention can be compactly collapsed for storage and transport.

Referring now to FIG. 1, there is shown generally an illustrative embodiment of a portable campfire barrier system 100 deployed in a ready-to-use configuration. The system 100 is typically deployed at the desired location on the ground (not separately represented) but the illustrative embodiment may also be deployed on other surfaces and, in the case of other illustrative embodiments, can be provided with a fire resistant bottom structure. In the ready-to-use configuration, a pliable containment wall 102 is arranged to form an open-ended fire barrier that is typically, although not necessarily, substantially cylindrical in shape. The containment wall 102 comprises an upper edge 124, a lower edge 126, a first end and a second end, 128 and 130 respectively. In the ready-to-use configuration, the containment wall 102 further comprises an overlap portion 132, the overlap portion 132 being the portion of the containment wall 102 which are held adjacent to each other between the first end 128 and the second end 130.

In the ready-to-use configuration, the upper edge 124 forms the top of the structure and is typically parallel to the ground, while the lower edge 126 is typically disposed on the ground. The containment wall 102 is secured in place by a plurality of support members 106 that are driven into the ground. It will be appreciated that the containment area 101, formed by the interior of the circle typically formed by the containment wall 102, is thereby surrounded on all sides except on the top, which is necessary for allowing fuel to be added to the campfire and for allowing smoke to escape.

The fuel, such as wood, coal, briquettes, or other suitable material, can be placed in the containment area 101 for combustion. Moreover, a flammable gas burner connected to a gas source can also be placed in the containment area 101. For the purposes of this application, the term "campfire" refers to a heat source burning any fuel, including the use of a burner and a flammable gas, such as propane.

Figure 2B:
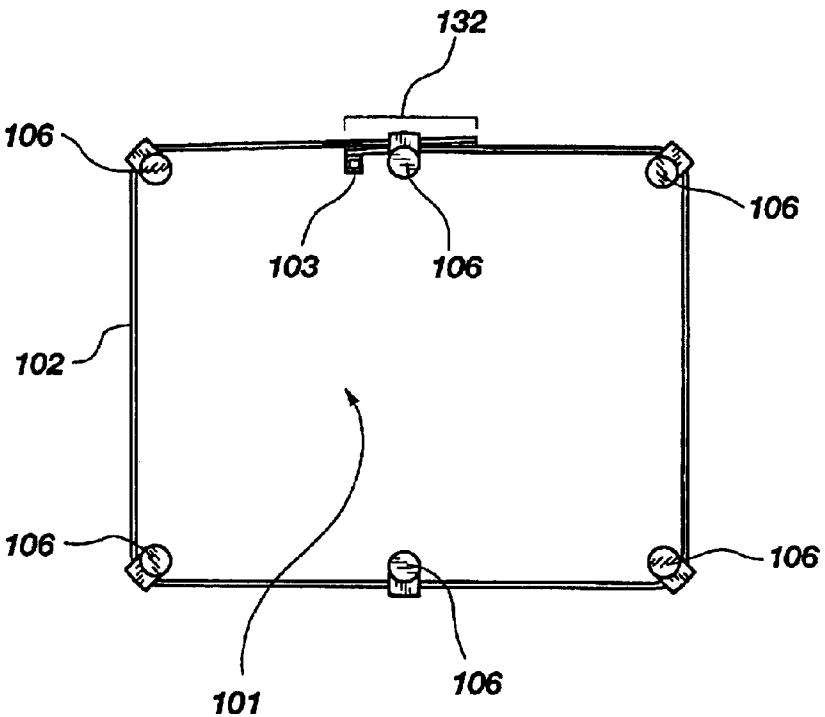
FIG. 2B is a top view of the embodiment of the present invention represented in FIG. 1 in a rectangular configuration.
Figure 2A:
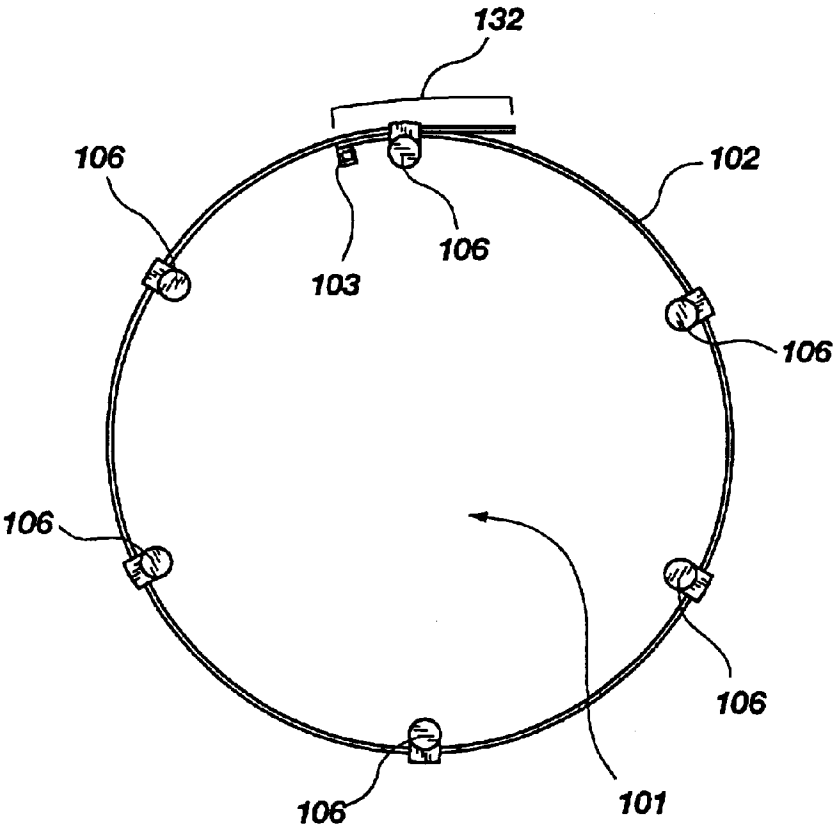
FIG. 2A is a top view of the embodiment of the present invention represented in FIG. 1 in a circular configuration.

As mentioned above, in the illustrated embodiment represented in FIG. 1 the containment area 101 is generally substantially cylindrical in shape and is surrounded on all sides, except the top, by the containment wall 102 or the ground (not explicitly represented) as illustrated in FIGS. 1 and 2A. The containment area 101 has an open top thereby allowing fuel to be placed in the containment area 101 and also allow the smoke and other combustion products to travel upwards. It should be noted, however, that the containment area 101 may be other shapes such as oval, oblong as well as rectangular or polygonal, a rectangular containment area 101 being represented in FIG. 2B. Other shapes are desirably possible due to the pliable nature of the containment wall 102. Thus, the person positioning the containment wall 102 is free to configure it in whatever shape is desired within the limitations of the material from which the containment wall 102 is composed.

Figure 3B:
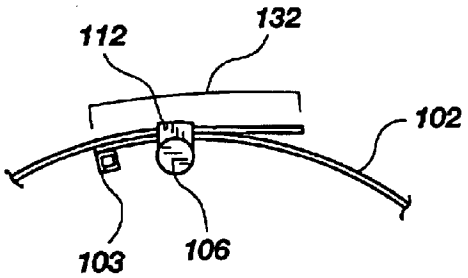
FIG. 3B is a top fragmentary view of the band represented in FIG. 1 in relationship to the support member, also represented in FIG. 1.
Figure 3A:
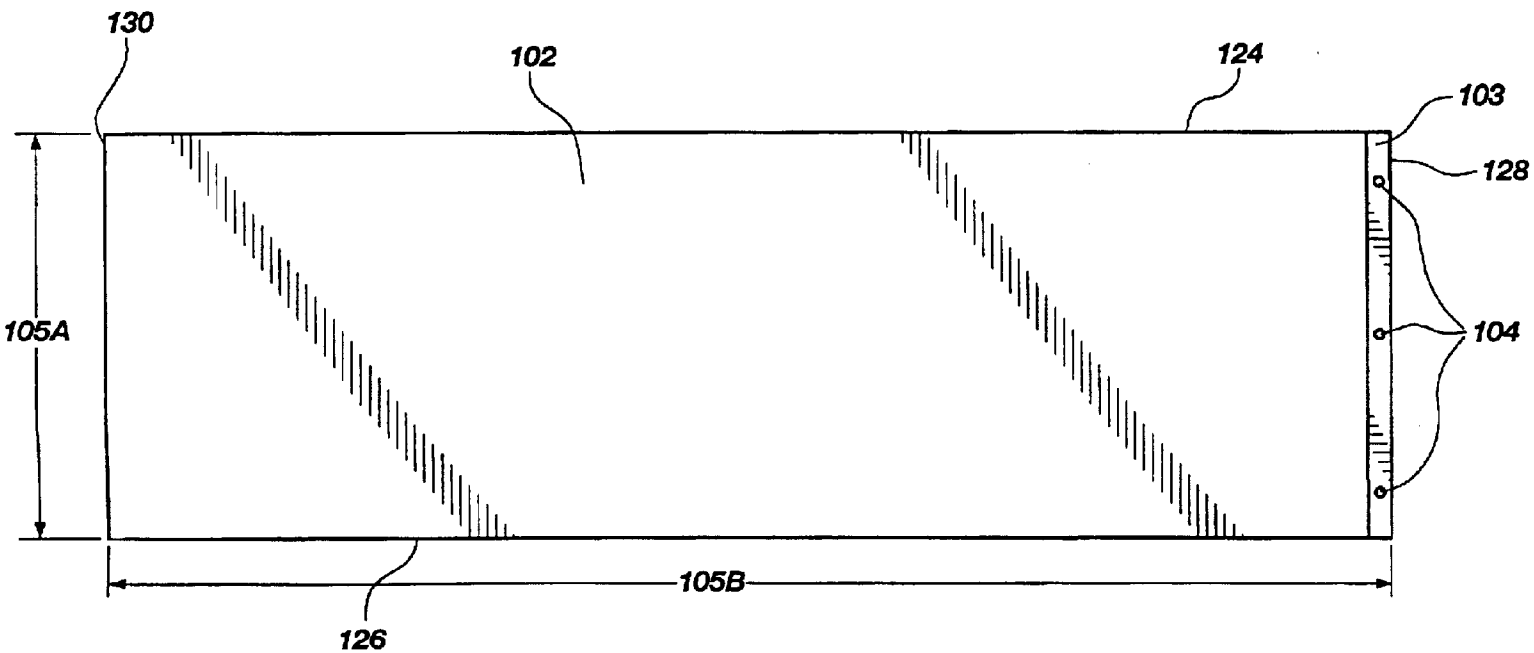
FIG. 3A is a plan view showing the containment wall represented in FIG. 1 unrolled.

The containment wall 102 should be of sufficient dimension (for example, the height of the containment wall is indicated at 105A in FIG. 3A) to prevent the fire, including most sparks and embers, from escaping to the surrounding area. For larger fires, the height of the containment wall 102 can be increased for additional safety. For commonly sized campfires, the height of the containment wall 102 may be selected to be in the range from about one and a half feet to about three and a half feet, but may be of any appropriate height.

The containment wall 102 generally is desirably constructed from a pliable metal, such as sheet metal, allowing it to be flexed to form the containment area 101. However, the containment wall 102 can be comprised of any pliable non-flammable material capable of forming the containment area 101. In the illustrative embodiment represented in FIG. 3A, the containment wall 102 is preferably made of 28 gauge galvanized sheet metal. It is undesirable to have the containment wall 102 formed from a material which is too rigid to configure into a desired shape.

It will be appreciated that the pliable nature of the containment wall 102 provides a structure providing advantages over the previously available devices. The containment wall 102 can be a single piece whereas the previously available device utilize a plurality of panels or sections connected end to end, requiring tedious assembly and allowing the panels to be lost or damaged. Furthermore, as shown in FIGS. 1, 2A and 2B, when deployed, the containment wall 102 is easily arranged to enclose the containment area 101 requiring no assembly of parts, such as panels, allowing for very rapid and easy deployment. As shown in FIG. 3A, when not deployed, the containment wall 102 can assume a flat configuration, or can be collapsed by rolling up the containment wall 102 for storage and transport as shown best in FIG. 4. When the deployed as shown in FIG. 4, the containment wall 102 is particularly suited for storage and transport.

As mentioned previously, the height of the containment wall, represented at 105A in FIG. 3A, can vary in the range from about one and a half feet to about three and a half feet, but may be of any appropriate height. The length of the containment wall 102, as represented at 105B in FIG. 3A, can vary as well depending on the desired size of the containment area 101. Generally, the length 105B may be between five and eight feet. It should be noted, however, that even with a containment wall 102 of fixed length, that the size of the containment area 101 can be varied by adjusting the overlapping portion 132 between the first end 128 and the second end 130 (see FIGS. 1, 2A, and 2B).

It will be appreciated that the containment wall 102 described herein is merely one example of a means for enclosing a campfire, and it should be appreciated that any structure, apparatus or system for enclosing a campfire which performs functions the same as, or equivalent to, those disclosed herein are intended to fall within the scope of a means for enclosing a campfire, including those structures, apparatus or systems for enclosing a campfire which are presently known, or which may become available in the future. Any structure which functions the same as, or equivalently to, the structures disclosed herein is intended to fall within the scope of the means for enclosing a campfire.

Figure 4:
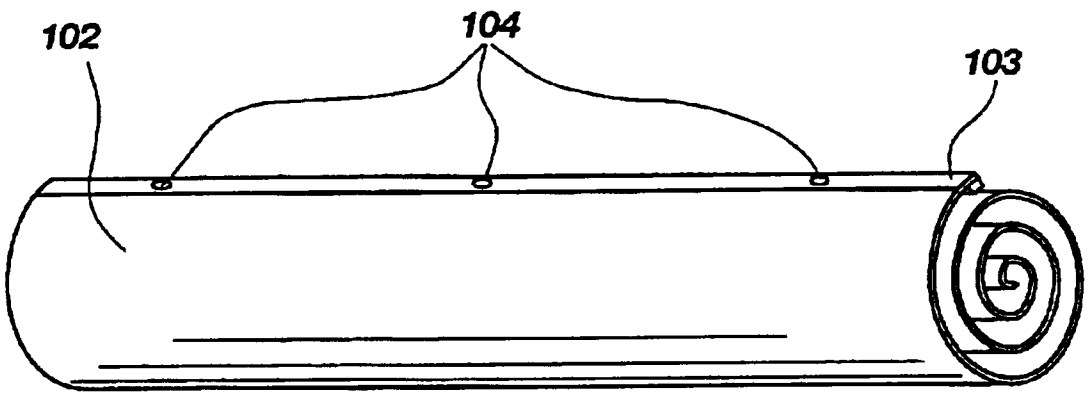
FIG. 4 is a side view showing the containment wall in a collapsed configuration for storage and transport.

As shown best in FIGS. 3A and 4, in the illustrative embodiment of the present invention, the containment wall 102 has a band 103 secured by fasteners 104, such as rivets, self tapping screws or other fasteners, near the first end 128. The band 103 serves to prevent the containment wall 102 from sliding off of the support members 106 when in the ready-to-use configuration. As can be seen best in FIGS. 1 and 3B, the band 103 prevents the containment wall 102, from sliding through the support member 106 positioned next to the band 103 and thus assists in maintaining the containment wall 102 in the desired configuration.

It will be appreciated that the band 103 described herein is merely one example of a means for maintaining the containment wall 102, or containment means, in the ready-to-use configuration, and it should be appreciated that any structure, apparatus or system for maintaining the containment wall 102 or containment means in the ready-to-use configuration which performs functions the same as, or equivalent to, those disclosed herein are intended to fall within the scope of a means for maintaining the containment wall 102 or containment means in the ready-to-use configuration, including those structures, apparatus or systems for maintaining the containment wall 102 or containment means in the ready-to-use configuration which are presently known, or which may become available in the future. Any structure which functions the same as, or equivalently to, the disclosed structure which maintains the containment wall 102 or containment means in the ready-to-use configuration is intended to fall within the scope of the means for maintaining the containment means in the ready-to-use configuration.

When not deployed, the containment wall 102 can be rolled up for transport and storage as represented in FIG. 4. Advantageously, the containment wall 102 can be readily rolled up for transport and storage due to its pliable nature. It will be appreciated by those skilled in the art, that the feature of being rolled up as a single pliable structure represents a significant improvement over the prior art which required the storage and transport of a plurality of rigid sectional members which necessitate tedious assembly and disassembly. The compact nature of the containment wall 102 when rolled up allows it to be easily placed in a bag, or other container, along with the support members 106 for storage and transport. Further, the one piece nature of the containment wall 102 eliminates the need for assembly or disassembly before or after deployment.

In the illustrative embodiment described above, the containment wall 102 is a unitary piece of a single material. In other illustrative embodiments, the containment wall 102 may be fabricated from different materials. In other embodiments of the present invention, the containment wall 102 may have visual designs, vents or other features cut into it or formed on it.

As mentioned previously, the support members 106, which function to secure the containment wall 102 in place, are typically driven into the ground to form the containment area 101 to have the desired size and shape. The support members 106 are typically composed of metal or other heat resistant material. Support members fabricated from materials such as plastic must be able to withstand the heat generated by the campfire without substantial loss of strength or integrity.

Figure 5A:
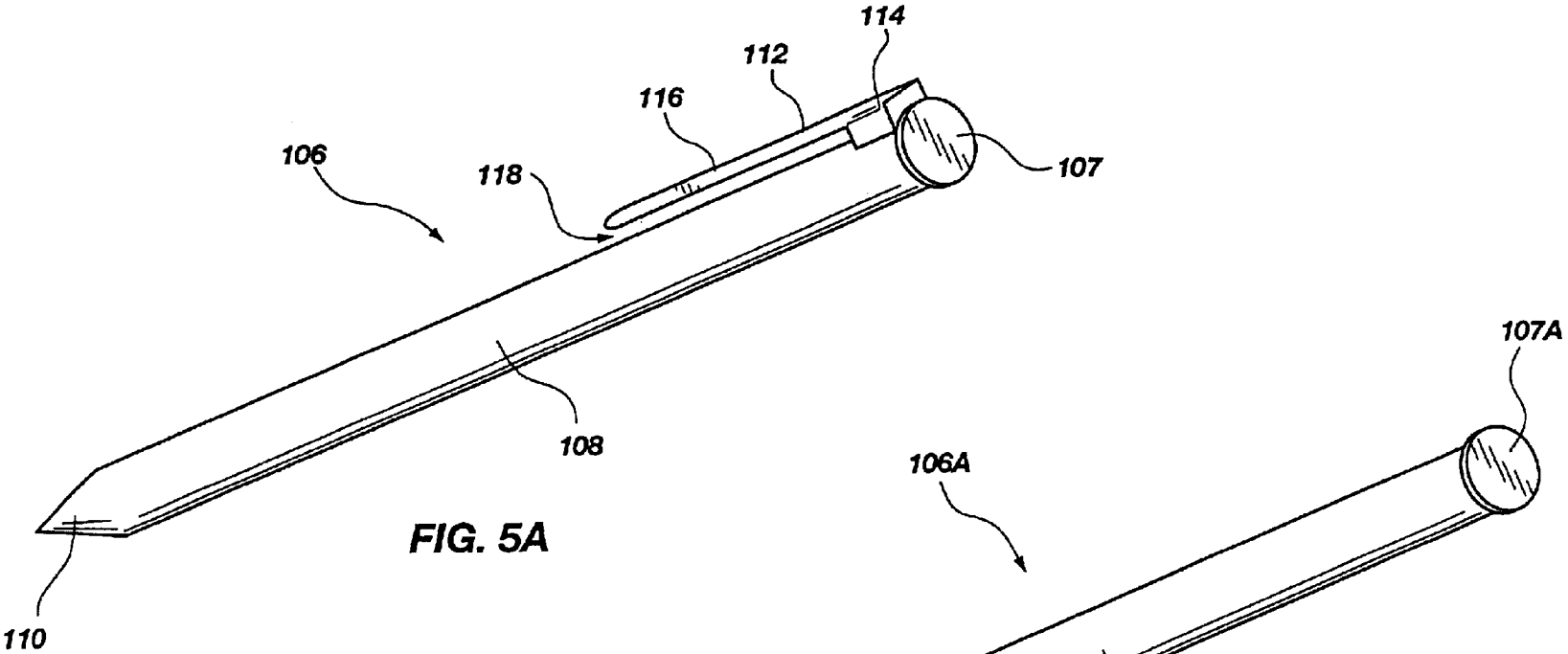
FIG. 5A is a perspective view of one illustrative embodiment of a support member in accordance with the present invention.

As shown best in FIG. 5A, each of the illustrative support members 106 has a head 107, a shaft 108 and a point 110. The head 107 functions to receive strikes from a hammer or other implement to drive the point 110 into the ground. The shaft 108 should be of a length longer than the height (see 105A in FIG. 3A) of the containment wall 102. The longer length of the shaft 108 allows the point 110 and a portion of the shaft 108 to be driven into the ground while allowing the head 107 to remain roughly even with the top of the containment wall 102 in the ready-to-use configuration. For example, the shaft 108 can be in the range from about six inches to about one foot longer than the height (see 105A in FIG. 3A) of the containment wall 102, but can be of other lengths in accordance with the teachings provided herein. The shaft 108 should be of sufficient strength and durability to withstand the repeated blows to the head 107 of the support member 106 during set-up.

Still referring to FIG. 5A, located near the head 107 of each of the support members 106 is a clip member 112. The clip member 112 is comprised of a base 114 and an elongated arm portion 116. The base 114 is coupled to the shaft 108 at or near the head 107 of the support member 106 by a spot weld or any other suitable method. The base 114 extends from the shaft 108 in a radial direction. The elongated arm portion 116 of the clip member 112 extends from the base 114 towards the point 110 of the support member 106. The elongated arm portion 116 is offset from the shaft 108, i.e., is not coupled to the shaft 108, to thereby form a slot 118 of sufficient width to closely receive the thickness of the containment wall 102. The slot 118 is formed between the elongated arm portion 116 and the shaft 108 of the support member 106. The length of the elongated arm portion 116 may be of any desired length, but should be of adequate length to hold the containment wall 102 in place when deployed. The preferred length is generally at least several inches. The slot 118 can illustratively be at least twice the width of the containment wall 102 to allows overlapping portions to fit within one slot 118, i.e., double wide.

Figure 5B:
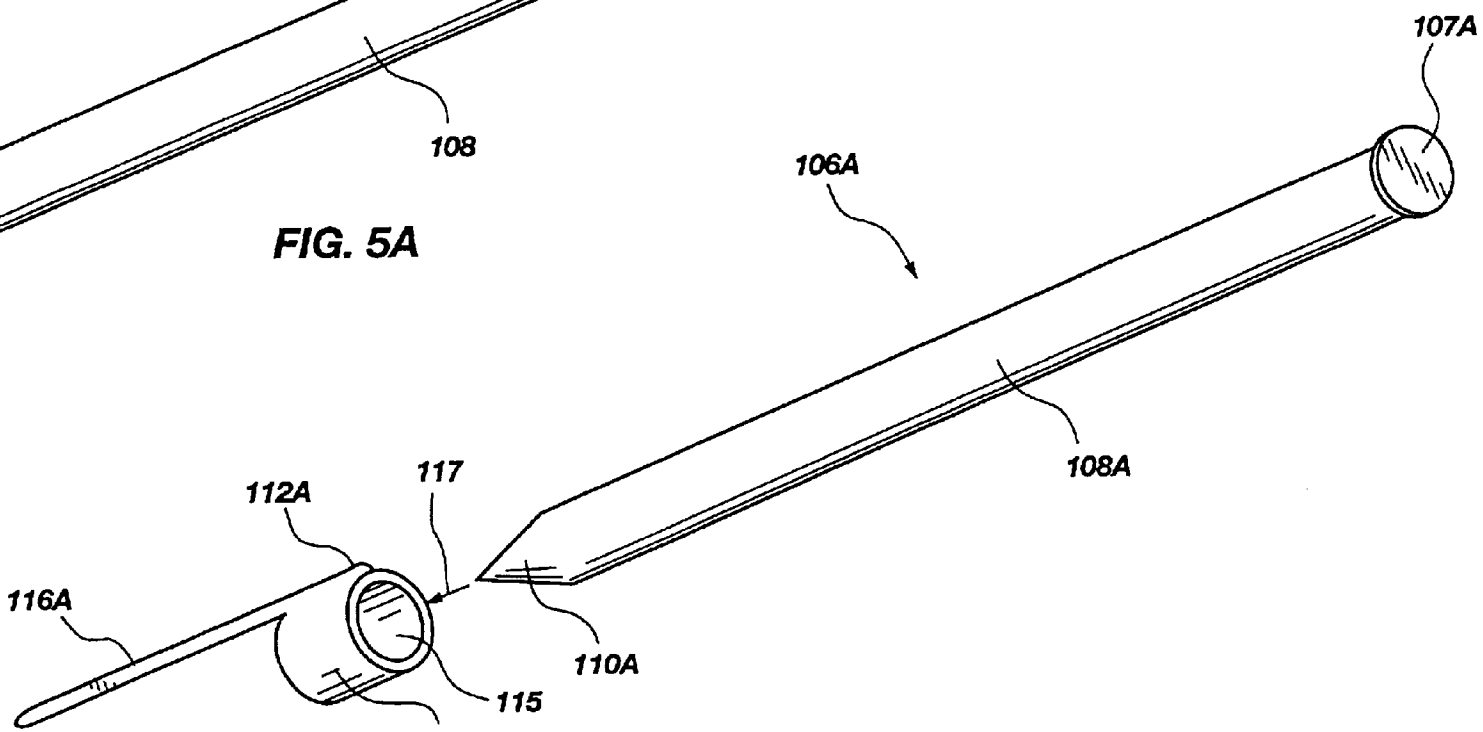
FIG. 5B is a perspective view of an illustrative alternative embodiment of a support member in accordance with the present invention.

FIG. 5B shows an alternate embodiment of the support member 106A and clip member 112A. In this embodiment, the clip member 112A consists of a base 114A and an elongated arm portion 116A. The base 114A is slidably mounted on the support member 106A. The base 114A comprises a passage 115 adapted to receive the support member 106A in the manner shown by the arrow 117. The base 114A can slide along the length of the shaft 108A. The elongated arm portion 116A forms a slot (not explicitly shown in FIG. 5B) between itself and the shaft 108A when the clip member 112A is slid onto the shaft 108A. As expressed above, in the illustrative embodiments the slot should be wide enough to accommodate overlapping portions of the containment wall 102.

Figure 6B:
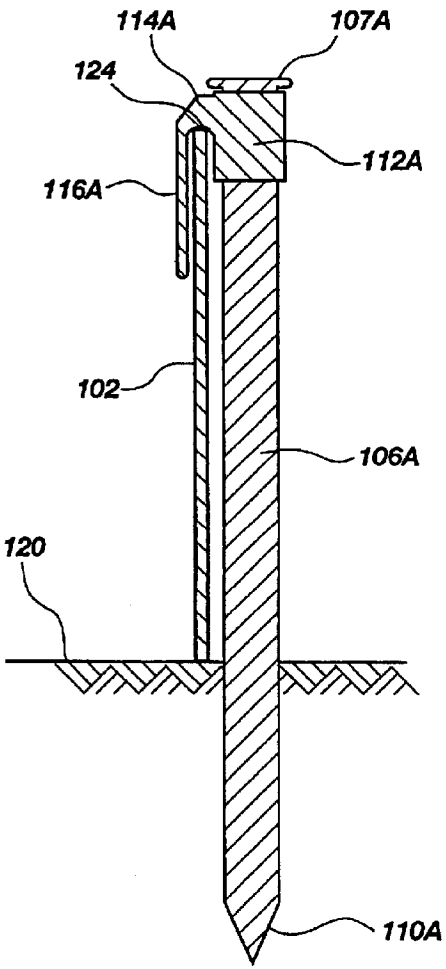
FIG. 6B is a cross sectional view of the containment wall and support member represented in the ready-to-use configuration of FIG. 6A.
Figure 6A:
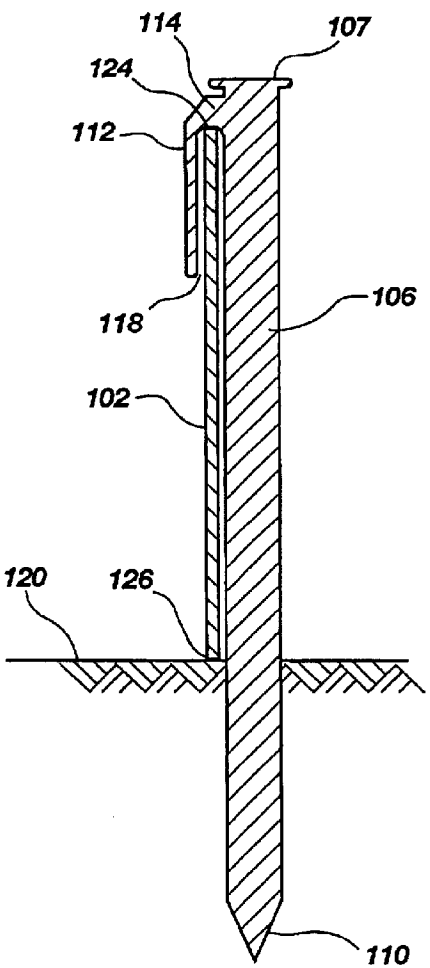
FIG. 6A is a cross sectional view of the containment wall with a support member represented in FIG. 5A, both deployed in a ready-to-use configuration.

FIGS. 6A and 6B are cross sectional views showing the support members 106 and 106A in the deployed configuration, respectively. In FIG. 6A, the point 110 is shown secured into the ground 120. The containment wall 102 is advantageously held in the slot 118 formed between the elongated arm portion 116 of the clip member 112 and the shaft 108 of the support member 106. The elongated arm portion 116 functions to hold the containment wall 102 in place. The upper edge 124 of the containment wall 102 abuts the base 114 thereby securing the lower edge 126 of the containment wall 102 to the ground 120. As shown in FIG. 6A, the head 107 of the support member 106 resides off of the ground at approximately the same height as the height of the upper edge 124 of the containment wall 102.

In FIG. 6B, the clip member 112A is shown slidably mounted on the support member 106A. The clip member 112A abuts against the head 107A of the support member 106A. The point 110A is secured into the ground and the containment wall 102 is held in the slot 118A formed between the elongated portion 116A of the clip member 112A and the shaft 108A. The upper edge 124 of the containment wall 102 abuts against the base 114A of the clip member thereby advantageously securing the lower edge 126 to the ground 120A. Again, the head 107A resides at approximately the same height as that of the upper edge 124 of the containment wall 102. It will be appreciated that it is within the scope of the present invention to utilize a structure to lock the clip member 112A in a desired position on the support member 106A in accordance with the teachings of the present invention.

It will be appreciated that the support members 106 and 106A described herein are merely examples of a means for securing the containment wall 102 or containment means to the ground, and it should be appreciated that any structure, apparatus or system for securing the containment wall 102 or containment means to the ground which performs functions the same as, or equivalent to, those disclosed herein are intended to fall within the scope of a means for securing the containment wall 102 or containment means to the ground, including those structures, apparatus or systems for securing the containment wall 102 or containment means to the ground which are presently known, or which may become available in the future. Any structure which functions the same as, or equivalently to, the disclosed means for securing the containment wall 102 or containment means to the ground is intended to fall within the scope of the means for securing the containment wall 102 or containment means.

Figure 7B:
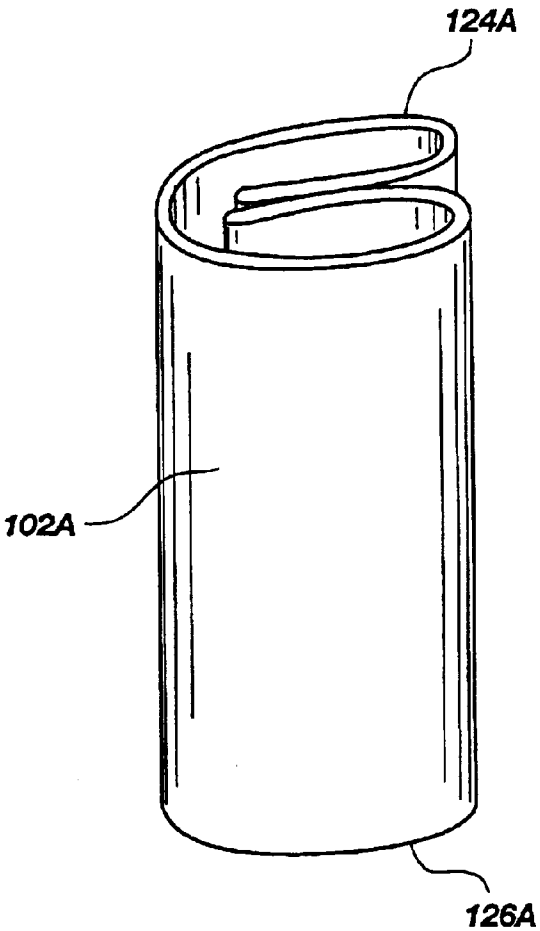
FIG. 7B is a perspective view of the embodiment represented in FIG. 7A showing the containment wall in a collapsed configuration for storage and transport.
Figure 7A:
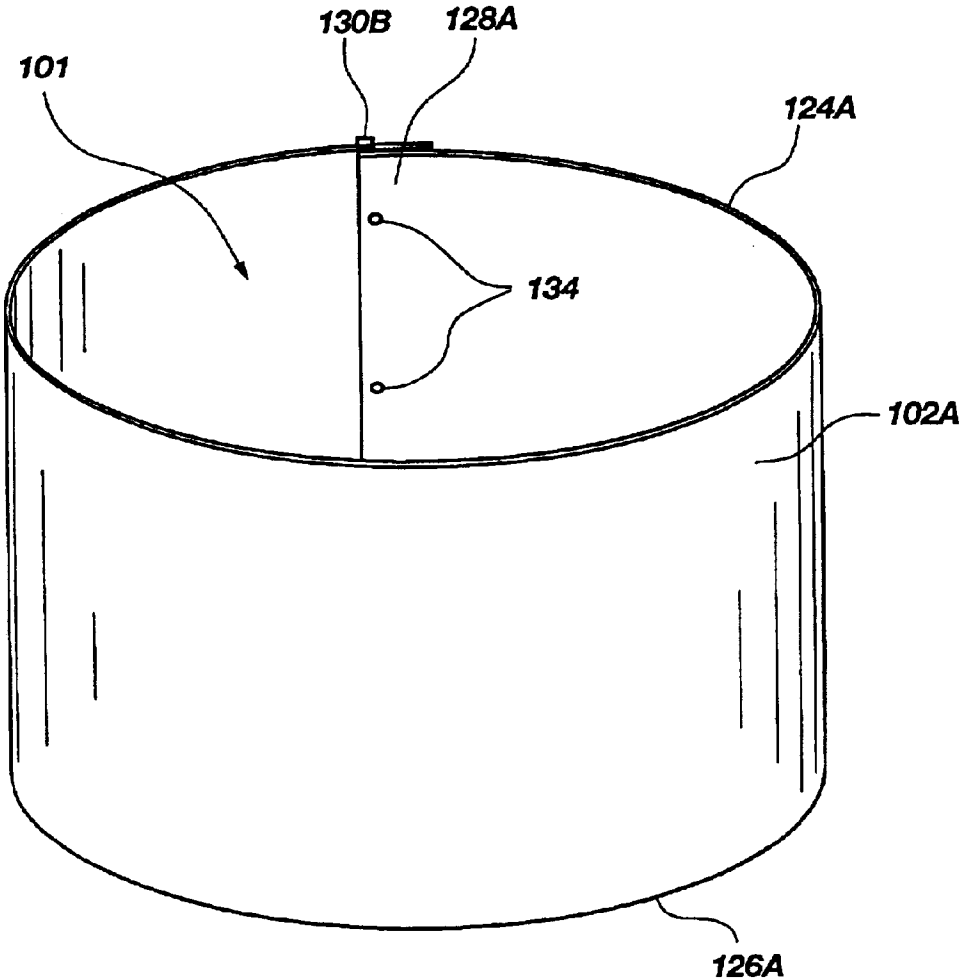
FIG. 7A is a perspective view of an illustrative alternative embodiment of the present invention utilizing a containment wall of fixed circumference.

A shown in FIG. 7A, in an alternative illustrative embodiment of the present invention, the first end 128A and the second end 130A of a containment wall 102A can be permanently coupled by a fastening means 134. The fastening means 134 can comprise rivets, screws spot welds, or any suitable fastening structure. In the embodiment represented in FIG. 7A, the containment wall 102A cannot be rolled out flat as shown in FIG. 3A, but the first end 128A and the second end 130A remain coupled. As shown in FIG. 7B, the containment wall 102A is collapsed inwardly for storage and transport. The inward collapse of the containment wall 102A is possible due to the pliable nature of the containment wall 102A.

Figure 8A:
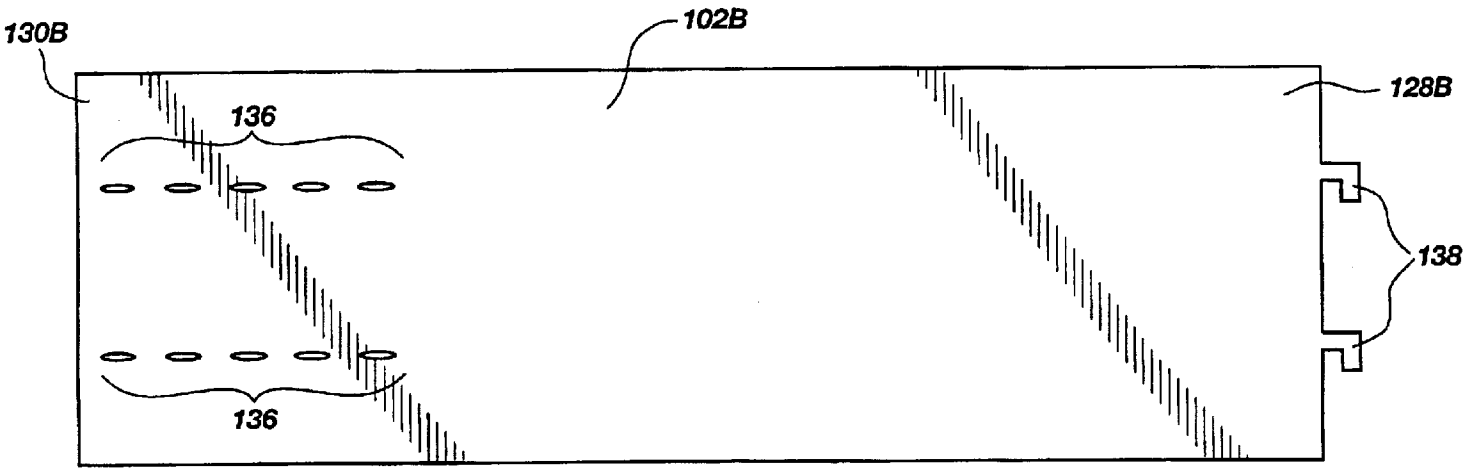
FIG. 8A is a side view of another illustrative embodiment of the present invention; and, FIG. 8B is a perspective view of the embodiment of the present invention represented in FIG. 8A in a ready-to-use configuration.
Figure 8B:
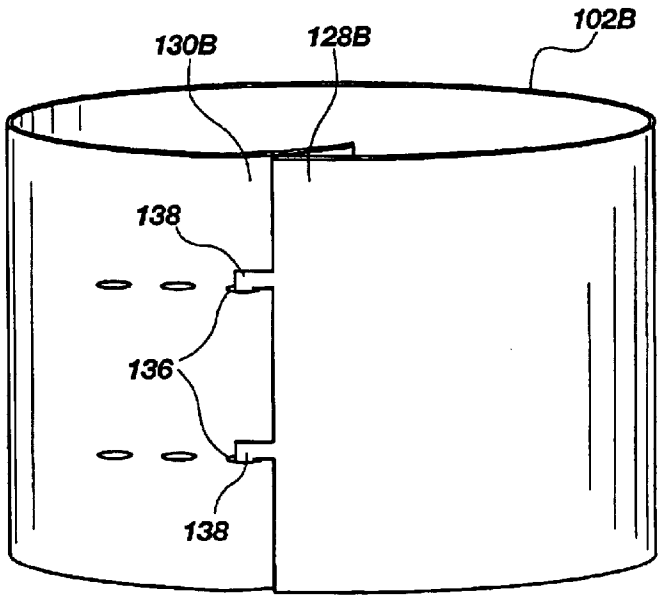

FIGS. 8A and 8B illustrate still another illustrative embodiment of the present invention utilizing a containment wall 102B. In the embodiment of FIGS. 8A and 8B, the containment wall comprises a plurality of slots 136 adapted to receive connectors 138. The slots are located near the second end 130B and are arranged in two parallel rows, the rows extending from the second end 130B towards the first end 128B. The slots 136 and connectors 138 allow the containment wall 102B to be deployed in the ready to use configuration at adjustable sizes. FIG. 8B shows the connectors 138 disposed in two of the slots 136 whereby the containment wall 102B is configured in the ready-to-use configuration. In order to adjust the size, the connectors 138 are inserted into different slots 136. Support members 106 (not shown in FIGS. 8A and 8B) can be employed to provide support for the containment wall 102B.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the illustrative embodiments of the present invention have been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A portable apparatus to prevent the spread of a campfire, the apparatus comprising:

a containment wall comprising an upper edge, a lower edge and opposing ends, the containment wall being pliable whereby the containment wall can be deployed in a ready-to-use configuration, the ready-to-use configuration enclosing the campfire thereby forming a contiguous barrier around the campfire; and a plurality of support members, each of the support members comprising a first end and a second end and a clip member coupled near the first end, the clip member including a slot adapted to receive the upper edge of the containment wall, and the second end of the support member adapted to engage the ground;

wherein the support members engage the containment wall and the ground such that the containment wall is maintained in the ready-to-use configuration.

2. The apparatus of claim 1 wherein the clip member comprises a base and an elongated arm portion, said base being permanently coupled to the support member and the elongated portion extending from said base towards the second end of the support member, said elongated portion being offset from the support member thereby forming said slot.

3. The apparatus of claim 1 wherein the clip member comprises a base and an elongated portion, said base being slidably coupled to the support member and the elongated portion extending from said base towards the second end of the support member, said elongated portion being offset from the support member thereby forming said slot.

4. The apparatus of claim 1 wherein each of the support members is comprised of steel, said first end being adapted to receive a driving force from a hammer and said second end comprising a point adapted for being driven into the ground.

5. A portable apparatus for containing a campfire, said apparatus comprising:

a pliant containment wall, said containment wall comprising an upper edge, a lower edge, and two opposing ends, said containment wall capable of selectively assuming a collapsed configuration and a ready-to-use configuration, the containment wall being rolled when in the collapsed configuration and the containment wall being arranged into a hollow cylinder having two open ends when in the ready-to-use configuration such that the opposing ends of the containment wall overlap each other; and a plurality of support members, each of the support members comprising a first end and a second end and a clip member coupled near the first end the clip member including a slot adapted to receive the upper edge of the containment wall, and the second end of the support member adapted to engage the ground;

wherein the support members engage the containment wall and the ground such that the containment wall is maintained in the ready-to-use configuration.

6. The apparatus of claim 5 wherein the clip member comprises a base and an elongated portion, said base being permanently coupled to the support member and the elongated portion extending from said base towards the second end of the support member, said elongated portion being offset from the support member thereby forming said slot.

7. The apparatus of claim 5 wherein the clip member comprises a base and an elongated portion, said base being slidably coupled to the support member and the elongated portion extending from said base towards the second end of the support member, said elongated portion being offset from the support member thereby forming said slot.

8. The apparatus of claim 5 wherein each of the support members is composed of steel, said first end being adapted to receive a driving force from a hammer and said second end comprising a point adapted for driving into the ground.

9. A system for containing an above ground campfire, said system comprising:

containment means for enclosing a campfire; and holding means for securing the containment means to the ground;

wherein the holding means comprises at least one support member operable to secure the containment means to the ground in a ready-to-use position, the at least one support member comprising a pointed end, a shaft and a head, the at least one support member further comprising a clip member, said clip member comprising a base and an elongated portion, the elongated portion extending from said base and forming a slot between itself and the shaft, said slot being adapted to receive the containment means.

10. The system of claim 9 wherein the base is spot welded near the head of the support member.

11. The system of claim 9 wherein the base is slidably mounted on the shaft of the support member.

* * * * *